United States Patent [19]

Jaye, Jr.

[11] Patent Number: 4,603,656

[45] Date of Patent: Aug. 5, 1986

[54] GALVANIZING APPARATUS

[76] Inventor: Frederick O. Jaye, Jr., 819 Crossroads Dr., Houston, Tex. 77079

[21] Appl. No.: 669,809

[22] Filed: Nov. 9, 1984

[51] Int. Cl.[4] ..... B05C 3/02

[52] U.S. Cl. ..... 118/429; 427/433

[58] Field of Search ..... 118/429; 427/433

[56] References Cited

U.S. PATENT DOCUMENTS 2,769,425 11/1956 Olson ..... 118/429

3,914,481 10/1975 Bostroem ..... 427/433 X

*Primary Examiner*—James R. Hoffman

*Attorney, Agent, or Firm*—Edmund F. Bard & Associates

[57] ABSTRACT

Method and apparatus for galvanizing articles sought to be plated and wherein a molten zinc bath into which articles sought to be plated are dipped, lays and is floated upon a molten bath of tin or lead, and wherein the molten zinc bath is contained above the molten tin or lead bath to form the dipping bath by a surrounding wall of refractory material. The interface between both of the molten baths is kept at least in the area of the refractory wall.

1 Claim, 2 Drawing Figures

GALVANIZING APPARATUS

BACKGROUND OF THE INVENTION

In a conventional galvanizing operation, the article sought to be plated is first dipped in a bath of cleaning fluid, and is thereafter dipped in a bath of molten zinc. The zinc bath, in turn, is contained in a steel pot or "kettle" enclosed by refractory material to form a fire box.

It is essential that the kettle be heated to a temperature great enough to completely melt the zinc. However, the temperature must also be held below about 870 degrees F., or the molten zinc will engage in a deteriorating interaction with the steel wall of the kettle. In this respect, it should be noted that this interaction is as much a characteristic of zinc as it is a characteristic of the temperature. Furthermore, the rate of heat transfer between the interior of the fire box and the zinc is a function of the exterior area of the wall of the steel kettle.

Zinc and silicon are also especially interactive at these temperatures, and therefore it has always been the practice to fabricate these kettles from steel having a very low silicon content. Until recently this was not a problem, because most steels have previously been made by the conventional "open-hearth" process which provides steel having a very low silicon content. Now, however, most steels are produced using the new "continuous casting technique, wherein the steel tends to have a much higher silicon content.

This shift within the steel-making industry, from open-hearth to continuous casting, has tended to create a problem for the galvanizing industry with regard to replacing these kettles as they burn out over time. Some steel will always be produced using the open-hearth process, of course, and it is also possible to produce steel with a lower silicon content on special order using the continuous casting process. Notwithstanding, it will be readily apparent that the technological improvements in the steel industry have created a shortage in the type of steel needed by the galvanizing industry.

These problems have been overcome by the present invention, however, and improved kettles are now provided which may be conveniently fabricated from steels having a higher silicon or carbon content than has heretofore been tolerable for galvanizing purposes.

SUMMARY OF INVENTION

In a particularly suitable form of the present invention, a novel kettle is provided which has an upper interior section having an inner liner of refractory material, and having a lower interior section with no inner liner. The kettle may be formed of any kind of steel, inasmuch as it is filled with molten lead to a level immediately above the lower edge of the refractory material, and inasmuch as the molten zinc resting on the lead will not interact with the liner of refractory material.

In a preferred form or embodiment of the present invention, a novel kettle is provided for containing molten zinc as a component of a galvanizing system of the type hereinbefore described. More particularly, the kettle may be of any type of steel of a strength capable of supporting the zinc bath, provided the kettle is formed with a lower section for supporting or holding a quantity of molten lead or other material which is nonreactive with the steel wall of the kettle, and with an upper section lined with refractory material or the like for holding the molten zinc.

In such a kettle, the molten zinc rests on the molten lead, and the molten lead preferably fills the kettle to a level opposite the lower part of its upper section. Thus, the molten lead not only keeps the molten zinc away from the steel wall of the kettle, it also serves to transmit heat into the molten zinc.

In a further particularly ideal embodiment of the present invention, method and apparatus are provided for galvanizing articles sought to be plated and wherein a molten zinc bath into which articles sought to be plated and dipped, lays and is floated upon a molten bath of tin or lead, and wherein the molten zinc bath is contained above the molten tin or lead bath to form the dipping bath by a surrounding wall of refractory material, and with the interface between the baths being kept at least in the area of the refractory wall that surrounds and contains the molten zinc.

In another particularly ideal embodiment of the present invention a method is described for galvanizing articles sought to be plated comprising the steps of supporting a molten zinc bath upon a bath of molten lead to form an interface between the two baths, encircling the molten zinc bath with a liner of refractory material, maintaining the interface in contact with said liner, and dipping the articles sought to be plated into the zinc bath above the interface.

In a still further particularly ideal embodiment of the present invention there is provided an apparatus for galvanizing articles sought to be plated comprising a kettle having a side wall and a bottom wall for containing a molten bath, a refractory material liner within the interior of the kettle adjoining the side wall thereof at the upper portion of the sidewall, and firebox means in spaced and surrounding relationship to both the side wall and the bottom wall of the kettle.

The present invention is also for and is directed to a method for galvanizing articles sought to be plated wherein such articles are dipped in a molten zinc bath, and wherein the improvement comprises the step of collecting dross formation from the dipping step in a zone defined by an interface formed between a molten lead bath disposed below and in supporting relationship to the molten zinc bath.

The present invention is further for and is directed to include a method for reducing the galvanic reaction in a galvanizing system having a molten zinc bath in a steel tank comprising the steps of interposing a liner of refractory material between the molten zinc bath and at least an upper portion of the tank, supporting the molten zinc bath within the tank on a molten led bath to form an interface with the molten zinc bath, and maintaining the interface between the molten zinc bath and the molten lead bath in the area of the tank defined by the liner of refractory material, in order to prevent the molten zinc bath from contacting directly any surface of the steel tank.

In addition, this invention relates to a method for galvanizing articles sought to be placed comprising the steps of lifting a molten zinc bath above the naked steel surface of the wall of a kettle, supporting the molten zinc bath on a molten bath of a material which is nonreactive with the steel wall of the kettle, shielding the molten zinc bath from the steel wall of the kettle by interposing therebetween a refractory material liner, maintaining the interface formed between the two baths in contact with the liner, supporting the steel wall of the kettle from bulging due to the weight of the non-reactive material, and dipping the articles sought to be plated into the molten zinc bath above the interface.

The present invention also further includes an apparatus for galvanizing articles sought to be plated having a kettle with a side wall and a bottom wall for containing molten baths, a refractory material liner within the interior of the kettle adjoining the side wall thereof at the upper portion of the sidewall, firebox means in spaced and surrounding relationship to both the side wall and the bottom wall of the kettle, a plurality of heat exchange fins extending from the bottom of the kettle and at least from the exterior of a portion of the sidewall of the kettle, a second plurality of heat exchange fins extending upwardly from the bottom wall and into the interior of the kettle, said sidewall including a first and second section joined one to another by a ledge extending substantially parallel to the bottom wall, a flange connected to the top of the first section being of a diameter substantially in excess of the diameter of the second section, said liner being disposed between said ledge and said flange and being of a material selected from the group consisting of alundum, aluminum oxide, bauxite brick, chrome brick, fireclay brick, magnesite brick, silica brick, silicon carbide, and zirconia brick, and other suitable refractory specialties having suitable properties, the bottom wall and the side wall of the kettle being constructed of a high strength steel, said kettle containing a first molten bath and a second molten zinc bath thereabove with the interface between the two baths being maintained in the area of the side wall in contact with the refractory liner, said first molten bath being lead or tin.

Accordingly, it is feature, object and advantage of the herein described and depicted present invention to provide apparatus and method for galvanizing articles sought to be placed and wherein the zinc plating bath is floated above a molten tin bath and bounded by refractory material.

It is another feature, object and advantage of the herein described and depicted present invention to provide a much higher rate of heat transfer in a galvanizing bath whereby the furnace efficiency is greatly increased.

It is a further feature, object and advantage of the herein described and depicted present invention to increase the kettle life in a galvanizing system by adding refractory material as a protection for the kettle.

It is yet another feature, object and advantage of the herein described and depicted present invention to reduce the galvanic reaction in a galvanizing environment between the zinc bath and steel kettle and thereby render kettle life predictably longer.

It is still another feature, object and advantage of the herein described and depicted present invention to perform high temperature galvanizing using a supporting bath of tin or lead having little or no affinity for steel and which can be supported under such conditions.

It is also a feature, object and advantage of the herein described and depicted present invention to provide a molten zinc galvanizing bath having internal and external heat exchange fins which not only increase the effective heating surface heat transfer-wise but add structural strength and rigidity to the bath in a supportive fashion.

It is also another feature, object and advantage of the herein described and depicted present invention to render available to galvanizing systems high strength steel for kettle construction and without being limited to low carbon and low silicon steels.

It is also a further feature, object and advantage of the herein described and depicted present invention to use lead as a heat transfer medium and as a support for the zinc in order to eliminate dross formation in the tank bottom but rather to force the dross to form at the interface.

These and other features, objects and advantages of the present invention will become apparent from the following detailed description wherein reference is made to the figures in the accomopaning drawings.

IN THE DRAWINGS

DETAILED DESCRIPTION

Figure 1:
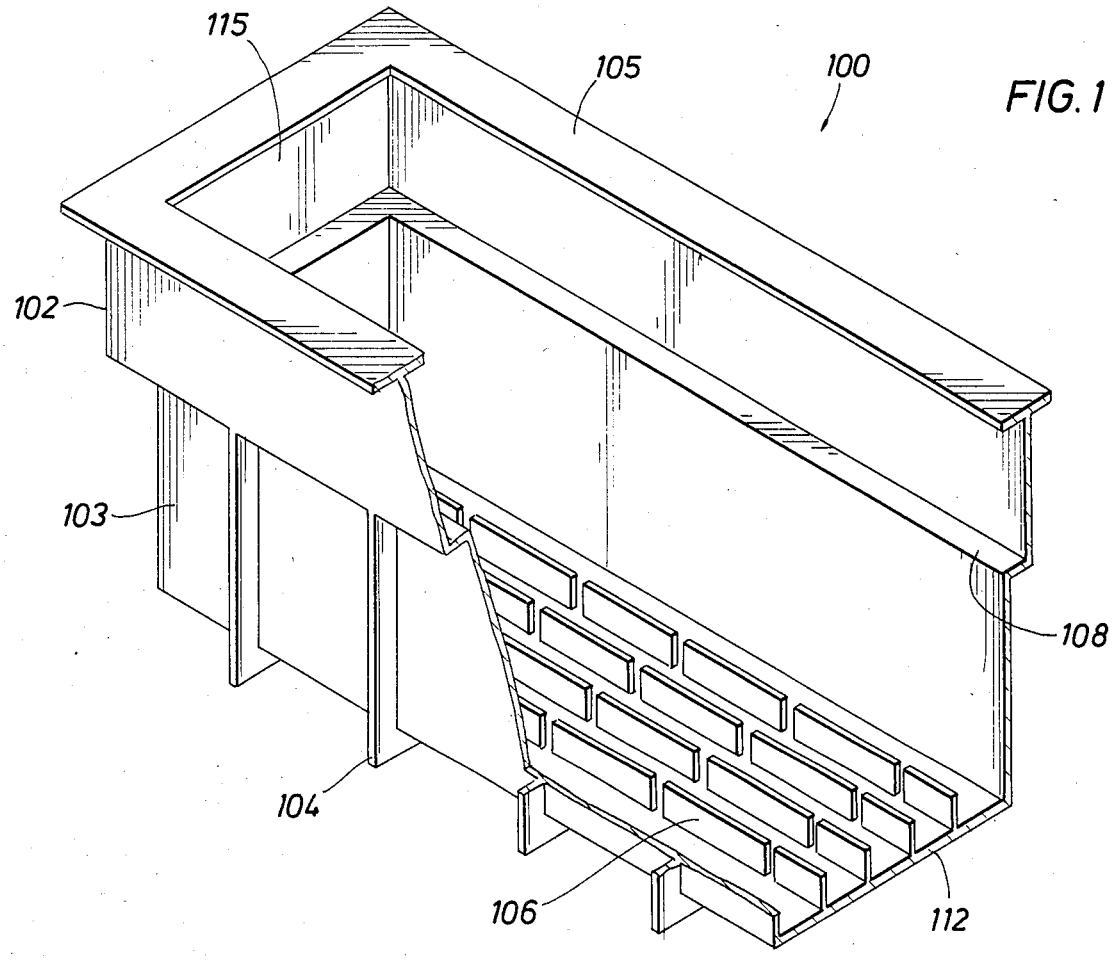
FIG. 1 is a pictorial representation of a galvanizing kettle constructed in accordance with the concepts of the herein described invention and having one end of the kettle cut-away to expose the interior arrangement and construction of the kettle.

In a galvanizing system, it is conventional to contain molten zinc in a heated steel pot or "kettle" which, in turn, is continually heated about its exterior.

The space about the exterior side-walls of a conventional steel kettle is enclosed by a wall of refractory material to form the "fire box," and the space within the kettle is occupied by the molten zinc.

The rate of heat transfer between the fire box and the molten zinc is a function of the area of exterior wall surface of the kettle. Also, the maximum temperature level of the zinc cannot go substantially above 870 degrees F., or else the zinc will tend to produce a deteriorating interaction with the steel wall of the kettle. This is as much a characteristic of zinc, however, as well as the temperature.

Zinc and steel are especially interactive, and therefore it has previously been necessary to make kettles from steel having a low silicon content.

Previously, most steel was made using the conventional open hearth process, wherein the steel has a much lower silicon content, and therefore kettles made from such steel did not experience undue deterioration for this reason. Now, however, most steel is being made by the new "continuous casting" technique, wherein the steel being produced will tend to have a much higher silicon content. It is possible to obtain lower silicon content steel from this new process, but availability of such steel is always a problem.

The herein disclosed and described kettle is built so as to have an upper and lower section, wherein molten lead will fill the lower section of the kettle up to and into the upper section, and wherein molten zinc will then lie upon the molten lead.

The inner surface of the upper section of the kettle is lined with refractory material whereby the level of the lead will be even with the lower portion of the refractory material, and whereby the zinc will be in contact only with the refractory material. In this way, the entire kettle may be made of any type of pressure-vessel steel, since lead will not interact with the silicon or carbon in the steel, and wherein the zinc is separated from the steel wall of the kettle by the refractory liner.

The lead bath not only lifts the zinc above the naked steel surface of the kettle wall, it also provides a much more effective medium for heating the zinc. The zinc, in turn, since it is now shielded from the steel wall of the kettle, may be effectively heated to and kept at a much higher temperature, and this permits the galvanizing process to proceed at a higher rate and in a more effective manner—especially for objects made of a high silicon-containing steel.

It should be noted, in this regard, that the galvanizing process is more than a mere plating effect, but that it is an exothermic reaction wherein some of the steel is actually alloyed with zinc from the bath. Moreover, if there is an excess of silicon in the steel, and if the steel is heated to these higher temperatures, the galvanizing process itself will be accelerated.

When an object sought to be galvanized is immersed only momentarily into the molten zinc, the effect of the higher temperature and the presence of silicon in the object is actually an advantage. If the steel kettle is continually exposed over a long period, however, the steel in the kettle will literally be "galvanized to death", which is the reason for the refractory liner in the upper portion of the kettle.

The kettle of the present invention preferably stands on a layer of refractory material, and that the firebox stands on a layer of retractory material, and that the fire may now extend under as well as about the sides of the kettle. In addition lateral fins or support brackets are preferably included to support the sidewalls of the kettle from bulging due to the weight of the molten lead, and also to greatly increase the exterior surface area of steel being heated from within the fire box.

The interior fins are preferably arranged to extend upwardly from the floor of the kettle, whereby heat may additionally be transmitted more effectively and efficiently into the molten lead in the kettle.

These fins perform a dual function. They enhance and facilitate heat transfer from the fire box into the interior of the kettle and they also strengthen the walls of the kettle against deformation by stress within the kettle. The second function is almost essential to the successful use of the lead in the kettle, because of the especially heavy weight of lead v. zinc.

The fins are valuable even in those instances wherein the kettle is filled entirely with molten zinc held to the lower temperature, since the thickness of a supported wall may be then reduced without risk of deformation, and a thinner wall will permit a more efficient and effective heat transfer into the contents of the kettle, irrespective of the other feature.

The interior fins on the floor of the kettle may be moved to, or be in addition to, similar fins on the interior surfaces of the sidewalls of the kettle.

Similarly, the vertical exterior fins may be in addition to exterior fins extending laterally about the exterior of the kettle.

The bracing advantage of the fins including the interior as well as the exterior fins, not only provides strength to the side walls and bottom of the kettle but they also greatly extend the overall useful life of the kettle even when the kettle contains only lead or some other material which is relatively non-interactive with the steel in the kettle wall. This is because continuous heating of the kettle is itself inherently destructive of the kettle, in that it inherently weakens the wall portions of the kettle over a progressive period of time. In this respect, experience has shown that the expected maximum useful life of a conventional kettle being used under normal operating conditions, is approximately 1½–2 years, whereas kettles formed according to the herein disclosed concepts are expected to have a normal useful life of at least 3½–4 years, and probably even longer, and even where the contents of the kettle are molten lead.

With reference to the drawings, and in particular with respect to FIG. 1, there will be seen a galvanizing kettle 100 constructed in accordance with the precepts of the present invention and including a bottom wall 112 and a lower wall section 103 extending upwardly therefrom. Bottom wall 112 includes a plurality of upstanding interior heat exchange fins 106 shown arranged in plural and parallel rows although other arrangements can be made provided that the interior fins 106 are substantially perpendicular to exterior fins 104. As noted hereinbefore, the function of interior fins 106 is to transfer heat from firebox 109 (FIG. 2) to the molten lead zone 113 and at the same time strengthen bottom wall 112 in order to accomodate the weight of baths 113 and 114. Similarly, the exterior fins 104 transfer heat from firebox 109 to bath 113 and at the same time provide structural strength and rigidity to lower wall section 103.

Figure 2:
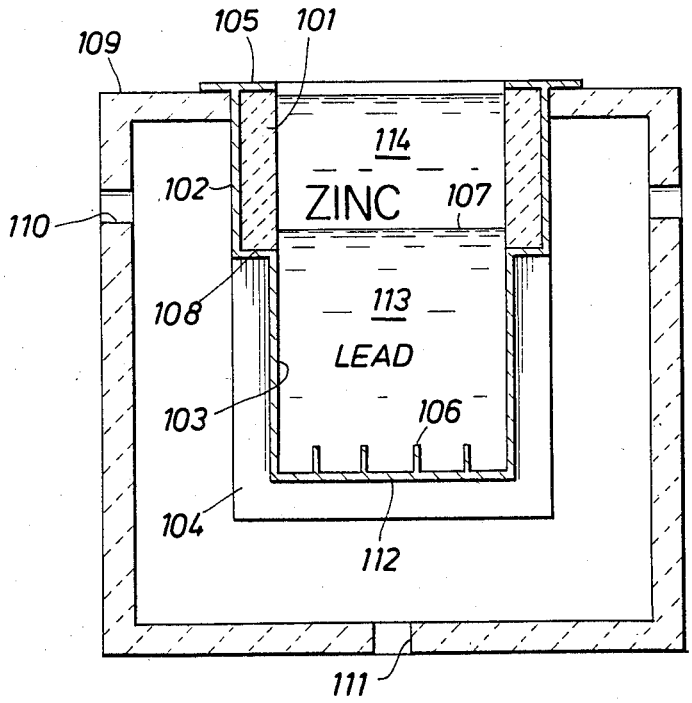
FIG. 2 is a pictorial representation partly in cross-section of a portion of the kettle of FIG. 1 and including the details and arrangement of the firebox for supplying a heating medium to the kettle.

In FIGS. 1 and 2 it can be seen that an upper wall section 102 joins the lower wall section at ledge 108 and that flange 105 forms the perimeter of upper section 102. The particular function of ledge 108 and flange 105 is to house a refractory liner material 101 the purpose of which is to house molten zinc bath 114 and to shield the zinc bath 114 from the steel of upper wall section 102. The interface 107 between the zinc bath 114 and the lead or tin bath 113 is preferred to be maintained in the zone of the liner 101 so as to prevent the molten zinc 114 from coming into contact with the steel of the lower wall section 103. Suitable refractory materials for the liner 101 may include but are not limited to ALUNDUM, aluminum oxide, bauxite brick, chrome brick, fireclay brick, magnesite brick, silica brick, silicon carbide, zirconia brick, and other suitable refractory specialties having suitable properties. Heat for the system is supplied by means of a firebox 109 having inlet and outlets 110 and 111, and arranged to extend about the side walls 102–103 of kettle 100 as well as to extend below bottom wall 112. In this fashion, heat from firebox 109 may be conducted to all portions of kettle 100 in order to raise or lower the temperatures in baths 113 and 114. While only one end wall 115 is seen in FIG. 1 it should be apparent that another is required although not specifically illustrated in the drawings. As noted hereinbefore, because of the specific gravity differences, an interface 107 will be found at the two baths 113 and 114, and that since the tin or lead used in bath 113 is heavier than dross, any dross formation will accumulate at interface 107 rather than fouling the bottom 112 of kettle 100 and interior fins 106. It is important that this interface 107 be kept in the area of liner 101 and not be allowed to fall below ledge 108 or into contact with lower wall section 103, in order to avoid the galvanic reaction between zinc and steel mentioned above. Similarly, the upper level of bath 114 must not contact flange 105 but must be maintained in the area of the refractory liner 101 to thusly shield the molten zinc bath 114 from any contact with steel parts. Thus, it can be seen that molten zinc bath 114 has molten lead or tin bath 113 to support its bottom and with refractory liner 101 to support its sides.

It should be apparent from the foregoing that after the article sought to be placed is first dipped in a bath of cleaning fluid, the article is thereafter dipped into the bath 114 of molten zinc in kettle 100 well above the interface 107 in order to prevent the article from coming into contact with the molten lead or tin bath 113 used to support the zinc bath 114. Since the kettle 100 is surrounded by firebox 109, sufficent heat may be supplied to wall 103 and bottom wall 112 in order to keep molten lead bath 113 at a temperature high enough to maintain the molten zinc bath 114 at below about 870 degrees F.

Kettle 100 as noted hereinbefore includes upper wall section 102 and lower wall section 103 which the molten lead 113 filling section 103 up to and slightly into section 102. The molten zinc bath 114 will then lie above and float on bath 113 only in area 102 of kettle 100 thereby keeping the molten zinc bath 114 out of contact with the high strength steel used to construct wall section 103. In addition, since the inner surface of wall section 102 includes the refractory liner 101, the molten zinc bath 114 will contact only the liner 101 rather than the naked steel of wall section 102. Thus, both of wall sections 102 and 103, as well as bottom wall 112, may be constructed of any steel without suffering the interactive and detriorating effect of zinc and steel. Since such an effect can be avoided, the result is that the zinc bath 114 can be heated to a higher operative temperature range than heretofore thought practical. This is aided by the fact that the supportive lead bath 113 is also a much more effective heat transfer agent. The exterior fins 104 support the sidewall sections 102–103 as well as the end walls 115 from bulging due to the combined weight of the two molten metal baths 113 and 114, and these fins 104 also greatly increase the rate of heat transfer from firebox 109 and into molten lead bath 113. In a similar fashion the interior fins 106 function to more efficiently transfer the heat from firebox 109 and into molten lead bath 113. Actually both sets of interior fins 106 and exterior fins 104 strengthen wall sections 102, 103, and 112, against deformation that could otherwise be caused due to the excessive weight generated by molten baths 113 and 114. It has been determined that if wall sections 102, 103, and 112 of kettle 100 are properly braced by fins of the type depicted at 104 and 106, the result is that wall section 103 can be constructed of a much thinner thickness which will thereby greatly enhance the effective heat transferred through the wall section 103 from firebox 109 and into lead bath 113. It is not essential that the heat transfer and strengthening fins 104 and 106 be arranged as illustrated but that in addition other fins of the type as fins 104 could be attached to wall section 103 so as to encircle the wall 103 much in the fashion of flange 105. Further, additional fins 106 could be added which run parallel to fins 104 rather than perpendicular as seen in the drawings.

In conventional galvanizing systems, the metal to be coated undergoes five distinct treatments. Initially, the metal is passed through a caustic bath where oils and greases are eliminated and the metal is thoroughly washed clean. A typical caustic used in this first stage bath is sodium hydroxide. From the first stage caustic bath the cleaned metal is passed to a second stage water rinse bath where caustic from the first bath is removed. The third stage bath in the process commonly contains an acid such as hydrochloric acid. This third stage bath is termed the pickling bath. It is in this third stage bath that the surface preparation of the metal to be galvanized occurs. Thus the pickling bath removes iron oxide from the metal object to be galvanized. From the pickling bath, the metal object passes to a fourth stage bath termed the preflux bath. This bath conventionally contains a solution of ammonium chloride and zinc chloride, and in this preflux bath the metal object undergoes secondary surface preparation where ammonium chloride and zinc ammonium chloride acting as a wetting agent are added to the surface of the metal object. The fifth and final conventional treatment bath in the galvanizing process is the galvanizing tank commonly containing molten zinc for application as a coating on the metal object having the surface thereof prepared as previously described in the initial four treatment stages.

It will be apparent from the foregoing that many other variations and modifications may be made in the structures and methods described herein without departing substantially from the essential concept of the present invention. Accordingly, it should be clearly understood that the forms of the invention described herein and depicted in the accompanying drawings are exemplary only and are not intended as limitations in the scope of the present invention.

What is claimed is:

1. Apparatus for galvanizing articles sought to be plated comprising a kettle having a side wall and a bottom wall for containing a molten bath, a refractory material liner within the interior of the kettle adjoining the side wall thereof at the upper portion of the sidewall, firebox means in spaced and surrounding relationship to both the side wall and the bottom wall of the kettle, a plurality of heat exchange fins extending from the bottom wall of the kettle and at least from the exterior of a portion of the sidewall of the kettle, a second plurality of heat exchange fins extending upwardly from the bottom wall and into the interior of the kettle, said side wall including a first and a second section joined one to another by a ledge extending substantially parallel to the bottom wall, a flange connected to the top of the first section being of a diameter substantially in excess of the diameter of the second section, said liner being disposed between said ledge and said flange, said refractory liner being a material selected from the group consisting of alundum, aluminum oxide, bauxite brick, chrome brick, fireclay brick, magnesite brick, silica brick, silicon carbide, and zirconia brick, the bottom wall and the side wall of the kettle being constructed of a high strength steel, said kettle containing a first molten bath and a second molten zinc bath thereabove with the interface between the two baths being maintained in the area of the side wall in contact with the refractory liner, said first molten bath being lead or tin.

* * * * *